United States Patent [19]

MacDonald et al.

[11] Patent Number: 4,790,412

[45] Date of Patent: Dec. 13, 1988

[54] ANTI-BUNCHING METHOD FOR DISPATCHING ELEVATOR CARS

[75] Inventors: Robert C. MacDonald, W. Caldwell; Elsa Abrego, Nutley, both of N.J.

[73] Assignee: Westinghouse Electric Corp., Pittsburgh, Pa.

[21] Appl. No.: 169,210

[22] Filed: Mar. 16, 1988

[51] Int. Cl.[4] ..... B66B 1/18

[52] U.S. Cl. ..... 187/127

[58] Field of Search ..... 187/124, 127

[56] References Cited

U.S. PATENT DOCUMENTS

| | | | |
|---|---|---|---|
| 3,443,668 | 5/1969 | Hall et al. | 187/127 |
| 3,450,231 | 6/1969 | Kuzara | 187/127 |
| 3,474,885 | 10/1969 | Hall et al. | 187/127 |
| 3,486,584 | 12/1969 | Hall et al. | 187/127 |
| 3,507,362 | 4/1970 | Kuzara et al. | 187/127 |
| 3,511,342 | 5/1970 | Hall et al. | 187/127 |
| 3,561,571 | 2/1971 | Gingrich | 187/127 |
| 3,614,997 | 10/1971 | Lusti | 187/124 |
| 3,731,765 | 5/1973 | Robaszkiewicz | 187/127 |
| 3,739,880 | 6/1973 | Robaszkiewicz | 187/127 |
| 3,742,445 | 6/1973 | Lauer | 187/130 |
| 3,815,712 | 6/1974 | Walton | 187/127 |
| 4,030,571 | 6/1977 | Kaneko et al. | 187/127 |
| 4,043,429 | 8/1977 | Hirasawa et al. | 187/127 |
| 4,081,059 | 3/1978 | Kuzunuki et al. | 187/127 |
| 4,166,518 | 9/1979 | Nakazato et al. | 187/127 |
| 4,323,142 | 4/1982 | Bittar | 187/127 |
| 4,355,705 | 10/1982 | Schroder et al. | 187/127 |
| 4,363,381 | 12/1982 | Bittar | 187/127 |
| 4,492,288 | 1/1985 | Schroder | 187/127 |
| 4,531,616 | 7/1985 | Uetani et al. | 187/124 |
| 4,718,520 | 1/1988 | Schroder | 187/127 |

*Primary Examiner*—William M. Shoop, Jr.
*Assistant Examiner*—W. E. Duncanson, Jr.
*Attorney, Agent, or Firm*—D. R. Lackey

[57] ABSTRACT

A method of assigning hall calls to a plurality of elevator cars in an ETA strategy in which up hall calls are scanned upwardly and down calls downwardly. A hall call floor at which the scan has stopped for the purpose of assigning or reassigning a hall call at the floor is called a "scan floor". The floor of the advanced position of the car being considered for assignment is called the "AVP floor". In order to favor the clustering of closely adjacent stops in a given car, and thus minimize car bunching, when a car has an intervening stop between the AVP floor and the scan floor, either the travel distance between the AVP floor and the scan floor, or the travel distance from an intervening stop to the scan floor, is used to develop a dynamic bias for the ETA of the associated car. The dynamic or variable bias is inversely proportional to the travel distance, i.e., the number of floors, between the relevant floors.

5 Claims, 9 Drawing Sheets

24
22
34
FLOOR # N
36
20
FLOOR # 2
30
32
CAR 0
CAR 1
CAR N
FLOOR # 1
26
CC
CC
CC
40
ADDRESS
28
38
INPUT INTERFACE
INTERRUPT
DATA
46
44
39
42
ROM
RAM
OUTPUT PORT
INPUT PORT
CPU
CONTROL
DATA 62
64
ENTER
INITIALIZE
66
78
INCREMENT TABLE POINTERS
76
CALL
N
Y
80
FETCH: CAR #, INSV, UPTR, AVAS, AVP, 3Z, FEN
82
INSV
N
Y
84
ETA ← OFFH
86
INCREMENT CAR POINTER
88
FINISHED
N
Y
90
SUB: ASSIGN
FEN
94
96
AVAS
98
SUB: ETA-A
102
ASSIGNED HALL CALL OR 3Z
104
DETERMINE FC
106
CAR CALL
108
UPTR = SCAN
110
SCAN SLOT CLOSER THAN FC
112
SUB: ETA-B
116
UPTR = SCAN
118
UPTR =FC DIR.
120
UPTR =FC DIR.
126
SCAN SLOT FARTHER THEN FC
122
SUB: ETA-C

154
COMPUTE
134
186
ACC
156
MOVING
158
DOORS CLOSED
160
LEAVING
159
ETA ← ETA+NIT+DCYT
168
ONE FLOOR RUN
172
ETA ← ETA+ACCT
170
ETA ← ETA+OFTT
188
HS
174
ETA ← ETA+HST• #FL+DECT
190
ETA ← ETA+ADT
162
IS STOP SCAN SLOT FLOOR
164
AVAS
176
ETA ← ETA+DOT
166
ETA ← ETA+DCYT
183
STOP BETWEEN AVP AND SCAN FL.
B ← K / |FLR−AVP|
185
ETA ← ETA−B
187
184
RETURN
Y
N

ANTI-BUNCHING METHOD FOR DISPATCHING ELEVATOR CARS

TECHNICAL FIELD

The invention relates in general to dispatching strategies for elevator systems of the hydraulic or traction type, and more specifically to a method of minimizing the bunching of elevator cars in an elevator dispatching strategy.

BACKGROUND ART

Hall calls have been assigned to a group of elevator cars by a large number of different strategies. A common strategy estimates the time of arrival (ETA) of each elevator car for a specific hall call to be assigned. A count is computed for each car which represents the time estimated for the car in question to reach the call floor with the proper service direction to serve the hall call. The hall call assignment is given to the car having the lowest ETA count.

The concept of car distribution in an elevator system is apparent when the constantly changing patterns of elevator traffic are considered. If the dispatching strategy keeps the elevators well distributed throughout the building, for conditions other than morning up-peak, they are in a better position to respond to future hall calls. Some strategies park or "spot" cars throughout the building when the traffic has subsided. Spotting, however, is inefficient, as the elevators are doing no useful work as they travel to parking floors, wasting energy and causing unnecessary wear and tear on the cars which increases maintenance costs.

While ETA is a relatively simple strategy calculating ETA times and allowing switching of assignments between cars based upon relative ETA times can lead to poor car distribution. Cars can bunch and race one another to answer hall calls. This leads to leap frogging, and "no-call" stops in which a car stops only to find another car has just arrived to serve the same call. This degrades elevator service, and is wasteful of energy. Thus, it would be desirable to incorporate a method in the ETA algorithm which solves the distribution problem as part of the assignment algorithm itself.

DISCLOSURE OF THE INVENTION

The present invention is a new method for minimizing bunching in an ETA dispatching strategy. In the assignment algorithm the floors of the building are sequentially processed, from bottom to top for up hall calls, and from top to bottom for down hall calls. In the calculation of ETA times for the cars, consideration is given to assignments that have already been made behind the floor, called the "scan floor" that is currently being processed, including stops that a car is committed to make behind the scan floor due to a car call. The trip list of each car is examined for committed stops behind the floor of the hall call being assigned. If a car already is committed to stop behind the scan floor, then this car is given a greater chance of getting the assignment for the floor of the hall call being processed by calculating a dynamic bias value, and subtracting this bias value from this car's calculated ETA. The dynamic or variable bias is inversely proportional to a predetermined travel distance of the elevator car. The predetermined travel distance may be the same regardless of whether the intervening stop is due to a car call or an assigned hall call, by using the travel distance between the present position of the elevator car being considered for assignment (called the AVP floor), and the scan floor. The "present position" or AVP floor is the actual floor location of the car when it is stationary, and the floor at which the car can make a normal stop when moving. Thus, the farther the scan floor is from the AVP floor in terms of travel distance which the car is committed to make to serve its trip list, the smaller the amount of time subtracted from the car's ETA. Thus, if the car is a relatively long distance from the scan floor, there is less likely to be a bunching problem, even when it has an intervening stop, and the amount of the bias reflects this by becoming insignificant. The result of the dynamic biasing is to cluster stops for a given car, maintaining a better car distribution throughout the building without placing "dummy" calls for parking floors. As cars become idle, chances are that they will already be suitably spaced from one another.

In another embodiment of the invention, the predetermined travel distance may depend upon whether the intervening stop is due to an assigned hall call or due to a car call. An assigned hall call may be reassigned, especially if the car is a relatively long way from the hall call floor. Thus, when the intervening stop is due to a hall call, the same travel distance used in the first embodiment, i.e., the travel distance from the AVP floor to the scan floor. When the intervening stop is due to car call, which is a stop that the car will make, the bias in favor of giving the hall call assignment to the presently considered car may be increased by making the predetermined distance equal to the travel distance from the car call floor to the scan floor.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENTS

The invention will be described relative to a specific, exemplary ETA dispatching system. It is to be understood, however, that the invention may be used to enhance any ETA type dispatching system.

Figure 1:
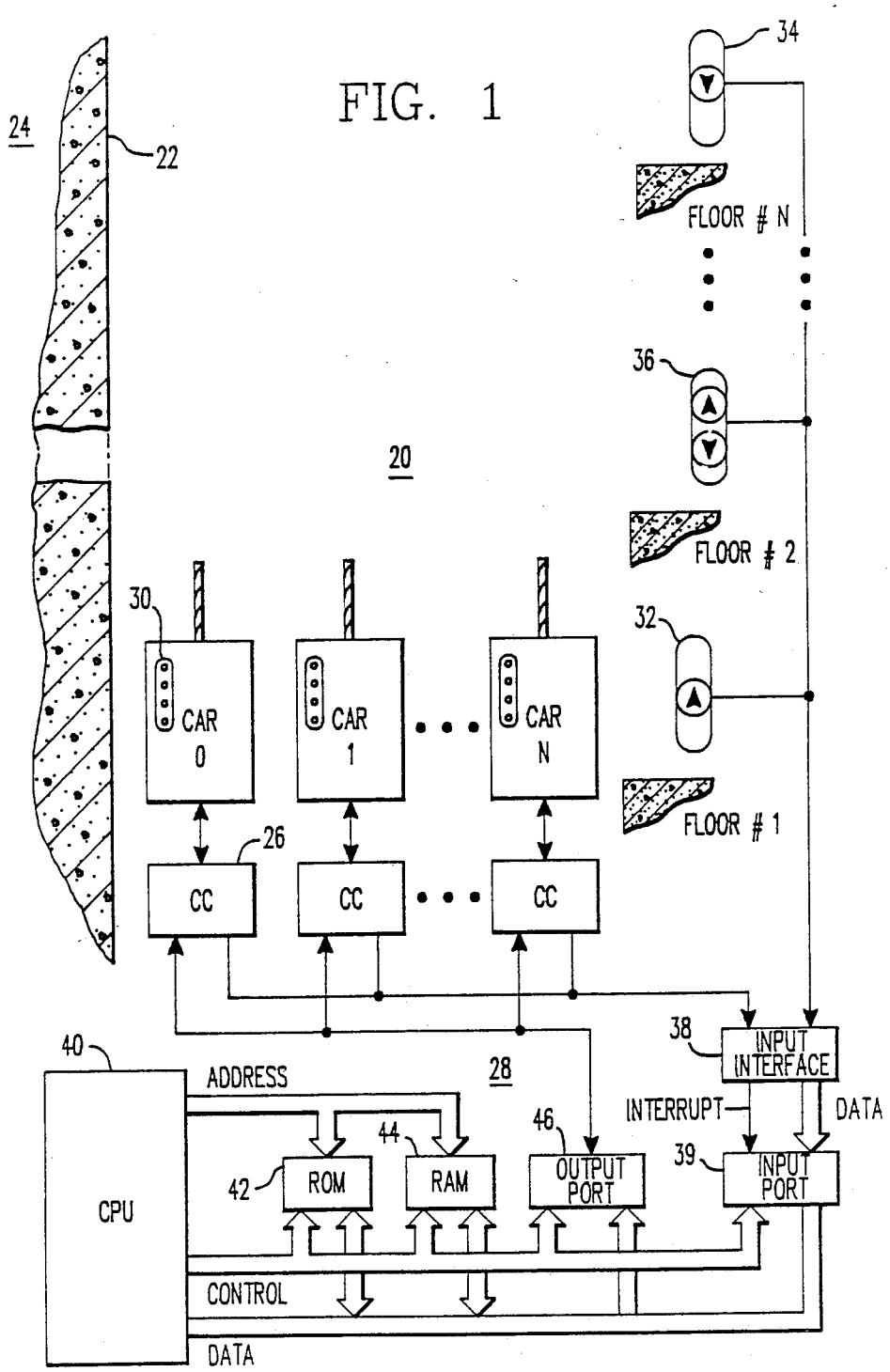
FIG. 1 is a diagrammatic representation of an elevator system which may utilize the dispatching methods of the invention.

Referring now to the drawings, and to FIG. 1 in particular there is shown an elevator system 20 which may benefit from the teachings of the invention. Elevator system 20 includes a plurality of elevator cars #0 through #N mounted for guided movement in hatchways 22 of a building 24 to serve the floors therein numbered 1 through N. Elevator cars #0 through #N, which cars may be of the hydraulic type, or of the traction type, as desired, each have a car controller, such as car controller 26 associated with car #0. The plurality of elevator cars #0 through #N are placed under group control by a system processor 28. A car controller which may be used for car controller 26 is shown in U.S. Pat. No. 3,750,850, with modifications thereof for group control by a system processor, including data links, being shown in U.S. Pat. No. 3,804,209. U.S. Pat. Nos. 3,750,850 and 3,804,209, which are assigned to the same assignee as the present application, are hereby incorporated into the specification of the present application by reference.

Car calls are registered in the elevator cars #0 through #N via suitable pushbutton arrays, such as pushbutton array 30 in car #0.

Hall calls are registered from suitable pushbuttons located at the various floors of building 24, such as an up hall call pushbutton 32 located at the lowest floor (floor #1), a down hall call pushbutton 34 located at the highest floor (floor #N), and up and down hall call buttons 36 located at each of the intermediate floors. The up and down hall calls may be serialized and transmitted to an input interface 38 of system processor 28 as signals 1Z and 2Z. The car calls registered in each of the cars may be serialized and transmitted to input interface 38 along with other per-car related information as signal 3Z. The per-car information includes car status signals, such as a signal INSV which is true when the associated car is in service; a signal UPTR which is a logic one when the associated car is set for up travel and a logic zero when it is set for down travel; a signal AVAS when an in-service elevator car is stationary, not busy and available for assignment, i.e., the car has no car calls and no assigned hall calls; a signal AVP which gives the advanced position of the associated elevator car in binary; a signal ACC which indicates the car is to accelerate away from a floor; a signal DEC which indicates the car should start decelerating to land at a target floor; a signal DCL which indicates that the car doors are closed; and a signal ACCX which is a start command. The per-car information also includes floor enable signals FEN which indicate which floors of the building 24 the associated car is enabled to serve. The floor enable signals may be set in memory tracks in the car controllers, or at a traffic director's station (not shown), as desired.

System processor 28, in addition to input interface 38, includes a central processing unit (CPU) 40, a read-only memory 42 (ROM), a random-access memory 44 (RAM), and an output port 46.

Figure 2:
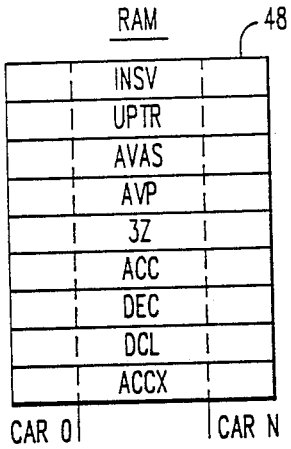
FIG. 2 is a RAM map listing per-car status information.
Figure 3:
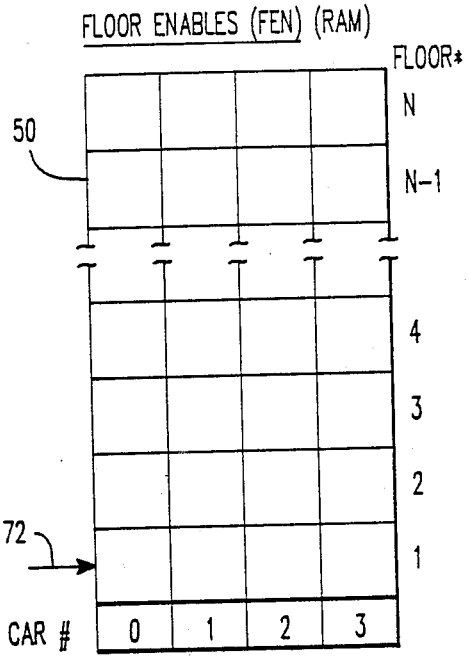
FIG. 3 is a RAM map listing per-car floor enable information.

As shown in the RAM maps of FIGS. 2 and 3, system processor 28 stores the per-car information in suitable tables in RAM 44, including a car status table 48 (FIG. 2) and a floor-enable table 50 (FIG. 3).

Figure 4:
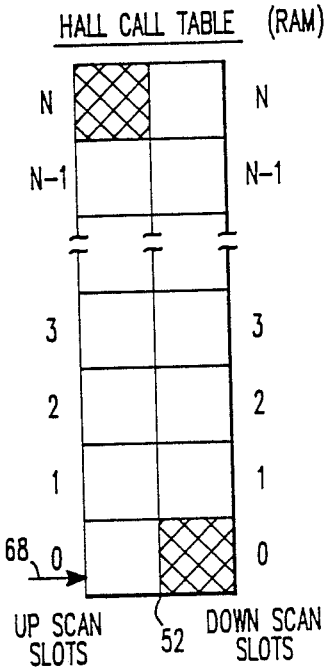
FIG. 4 is a RAM map of a hall call table.
Figure 5:
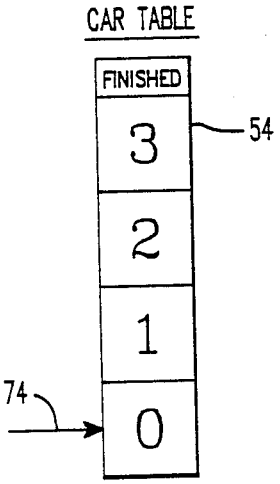
FIG. 5 is a RAM map of a car table.
Figure 6:
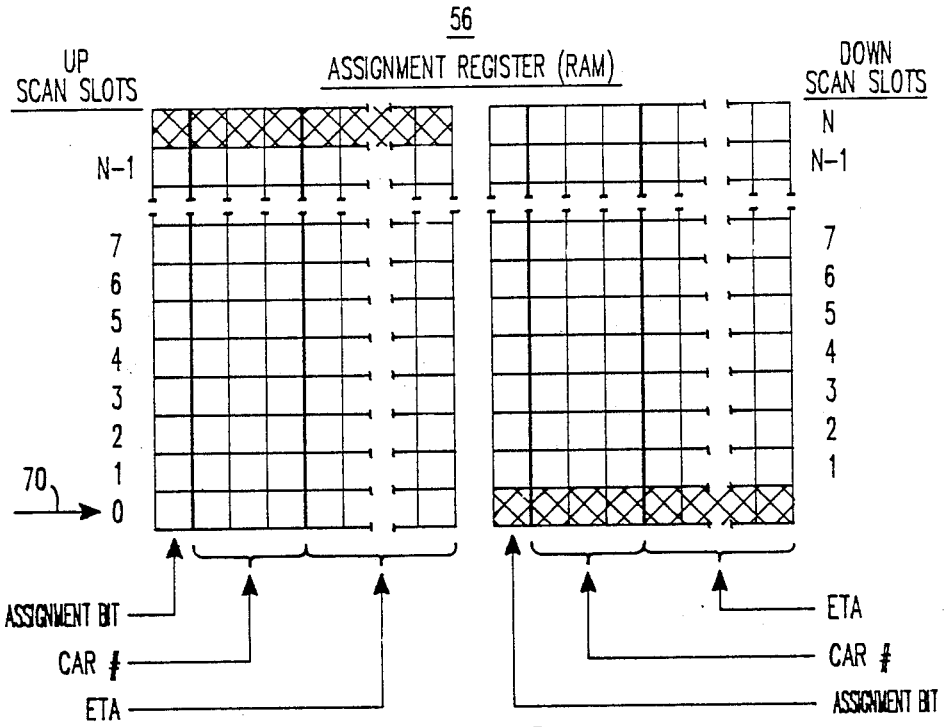
FIG. 6 is a RAM map of an assignment register.
Figure 7:
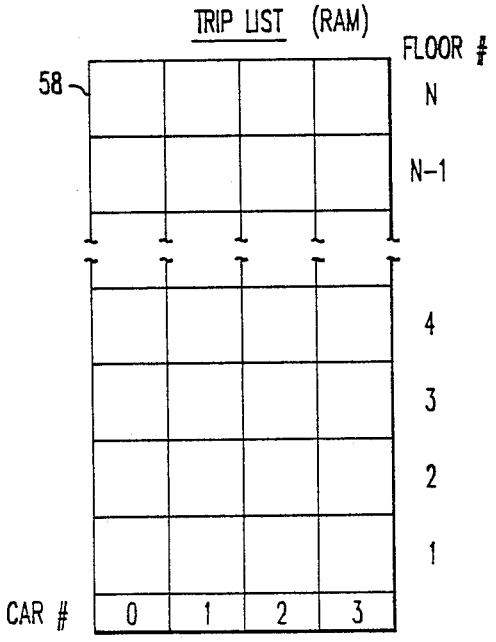
FIG. 7 is a RAM map of a trip list.

System processor 28 additionally prepares a hall call table 52 shown in FIG. 4, a car table 54 shown in FIG. 5, an assignment register 56 shown in FIG. 6, and a trip list table 58 shown in FIG. 7. The hall call table 52 may be integrated into the assignment register 56 if desired, by adding a "call" bit next to the assignment bit in both the up and down call portions of the register.

Figure 8:
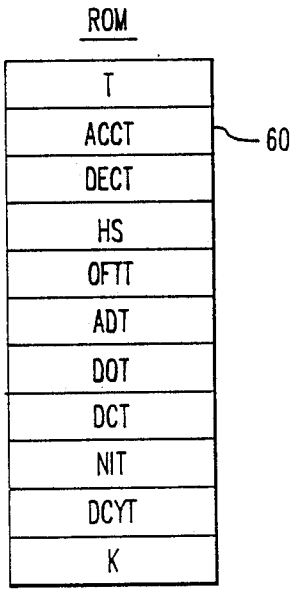
FIG. 8 is a ROM map listing various time periods to be used by a hall call assignment program.

FIG. 8 is a ROM map 60 which includes a list of constants stored in ROM which pertain to the specific elevator system 20. The constants include the time T in seconds by which the lowest ETA for a hall call must be lower than the ETA of a different car which was previously assigned to serve the hall call being considered, before the assignment will be switched to the different car. The constants also include a listing of times in seconds for the specific elevator cars in system 20 to perform the various functions required to serve the floors, including the time ACCT to accelerate from a floor to full speed; the time DECT to decelerate from full speed and land at a target floor; the time HS to travel from one floor level to another at full speed; the time OFTT for a car to make a one-floor run; the time ADT to land at a target floor when the car being considered is already in the process of decelerating; the time DOT for the elevator car door and associated hatchway door to fully open; the time DCT for the elevator car and hatch doors to travel from a fully open position to a fully closed position; the non-interference time NIT for which the car and hatchway doors are normally maintained open to answer a call; and the door cycle time DYCT which is the sum of DOT, NIT and DCT.

Figure 14:
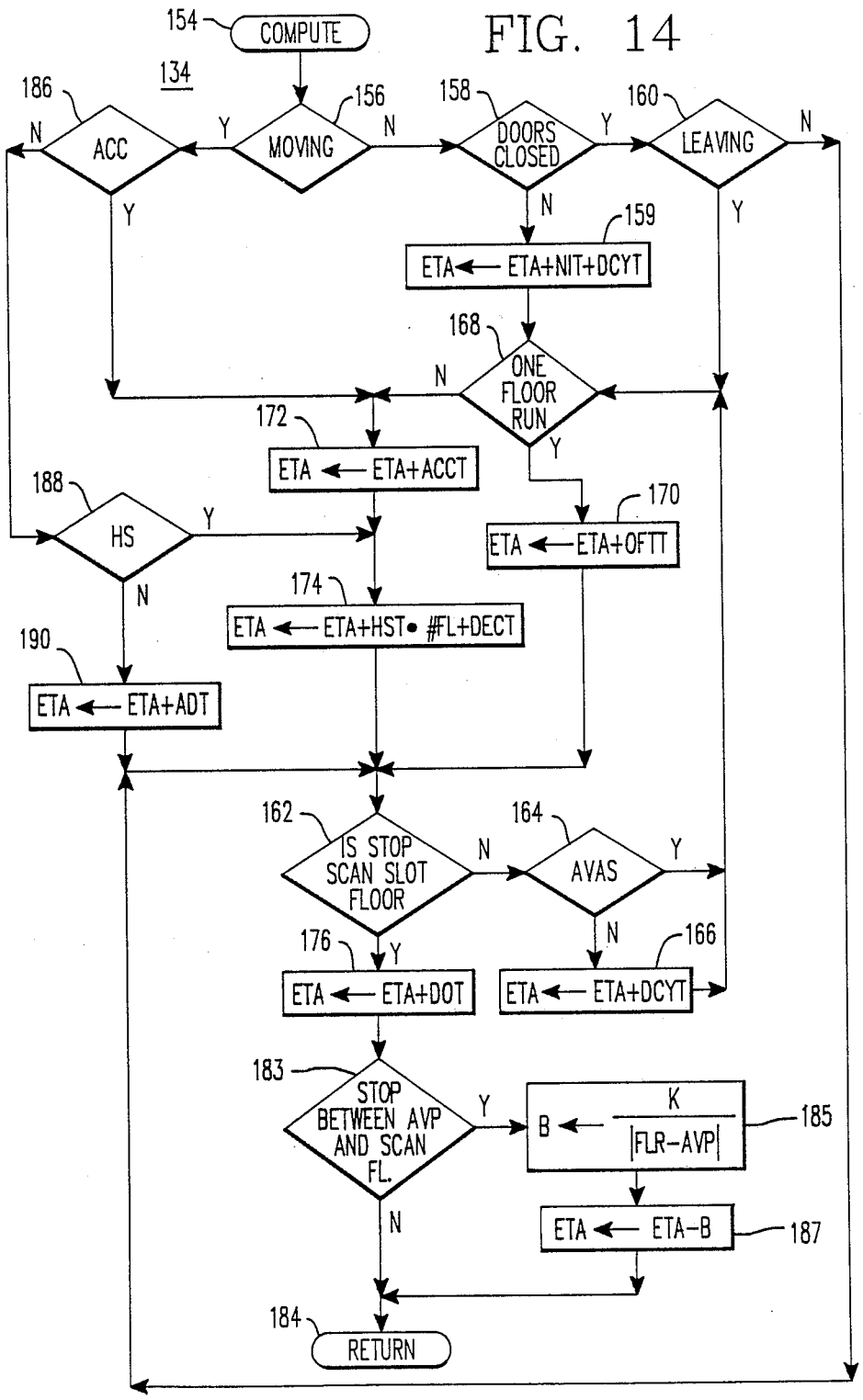
FIG. 14 is a flow chart of a subroutine COMPUTE which may be used by subroutines ETA-A, ETA-B and ETA-C in computing the ETA travel time for a car to service a trip list prepared for the selected travel path.

According to the teachings of the invention, ROM map 60 also includes a constant K used by the program shown in FIG. 14 to dynamically bias the ETA value of a car having stops behind the scan floor, i.e., the floor of the hall call being assigned.

Figure 9:
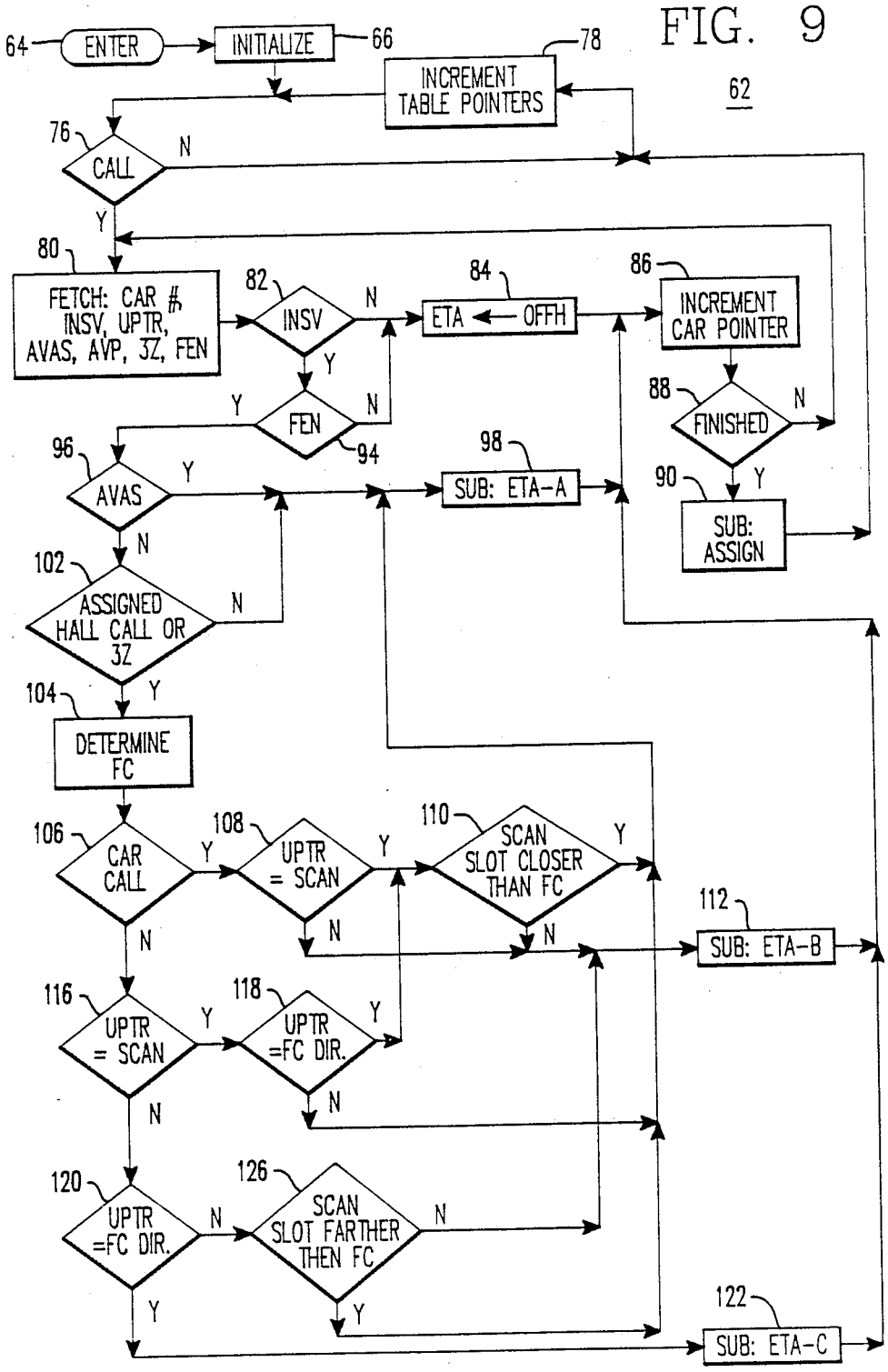
FIG. 9 is a flowchart of a program which assigns hall calls to a plurality of elevator cars.

FIG. 9 is a detailed flowchart of a hall call assignment program 62 stored in ROM 42. Program 62 is entered at 64 and step 66 initializes the system, such as by setting table pointers to initial positions. For example, step 66 places pointer 68 at the lowest up scan slot position so the program starts by looking for an up hall call at the lowest floor. When this pointer is incremented, it will go upwardly through the up hall call table. When it is incremented from the up scan slot for floor N−1 it will jump to the highest scan slot in the down hall call portion of the table. When the pointer is incremented downwardly through the down hall call table, it will jump back to the lowest scan slot in the up hall call portion of the table when it is advanced from the scan slot associated with the next to the lowest floor. Thus, the up scan slots are numbered 0 through N−1, and the down scan slots are numbered from N through 1. In like manner, pointer 70 is initialized at up scan slot 0 in the assignment register 56 shown in FIG. 6. Additional pointers to be initialized by step 66 include pointer 72 to the floor enable table 50 shown in FIG. 3, and pointer 74 to the car table 54 shown in FIG. 5.

After the initialization step 66, step 76 checks pointer 68 of the hall call table 52 for a registered up hall call. If no hall call is found, step 78 increments pointers 68, 70 and 72 of tables 52, 56 and 50, respectively, and the program returns to step 76. The program 62 thus loops through the up and down hall call tables continuously until step 76 finds a registered up or down hall call.

When step 76 finds a registered hall call, step 80 checks pointer 74 of the car table to determine which car is presently being considered for the hall call, it obtains the car status information associated with this car from the RAM map 48 shown FIG. 2, and it obtains the floor enable data FEN for this car from the floor enable table 50 shown in FIG. 3.

Figure 10:
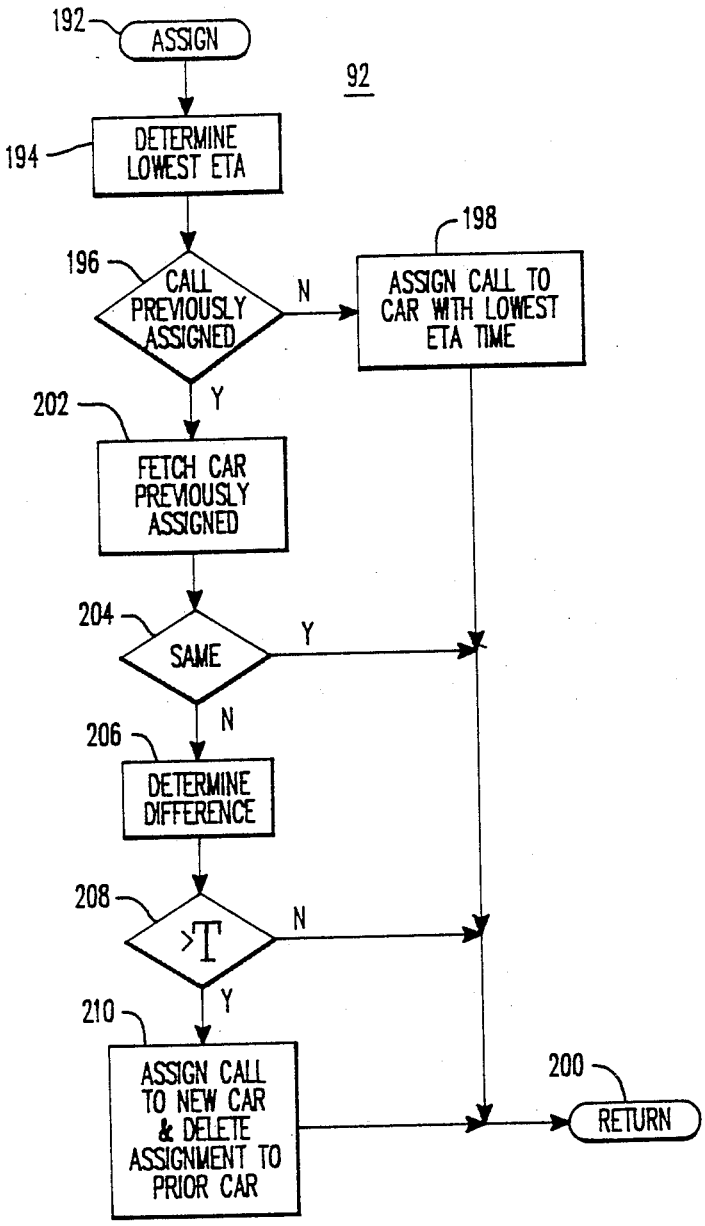
FIG. 10 is a subroutine ASSIGN called by the program shown in FIG. 9 to make specific assignments of hall calls to the elevator cars.

Step 82 checks the logic level of signal INSV to determine if the car being considered is in service. It this car is not in service, step 84 sets the ETA time for this car to the maximum value OFFH, and the program will not consider a car having the maximum ETA for assignment. Step 86 increments the car pointer 74 in the car table 54 of FIG. 5, and step 88 determines if the whole car table has been considered relative to the call in question. If one or more cars remain to be considered, step 88 returns to step 80 to obtain information relative to the newly selected car. If step 88 finds that all of the cars have been considered relative to the hall call in question, the program calls subroutine ASSIGN in step 90. Subroutine ASSIGN is shown in FIG. 10 which is a flowchart of an assignment program 92 which will be hereinafter be described in detail.

Returning to step 82, if step 82 finds that the car being considered is in service, step 94 checks the floor enable bit FEN to see if this car is enabled for the floor of the hall call. If this car is inhibited from serving hall calls at this floor, step 94 returns to step 84 and proceeds through steps 86, 88 and 90, which were previously described.

Figure 11:
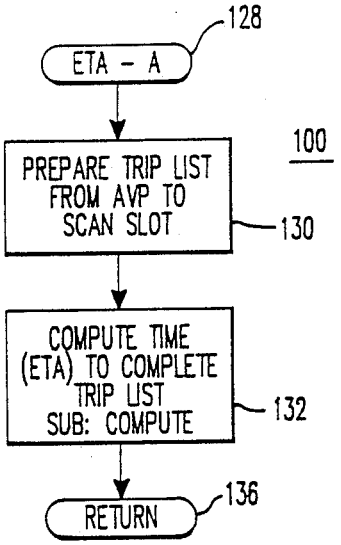
FIG. 11 is a flow chart of a subroutine ETA-A which establishes a first travel path for an elevator car to service a hall call to be assigned.

If step 94 finds that the car being considered is enabled for the floor of the hall call being considered, step 96 checks signal AVAS to determine if the car is busy serving a call, or if it is idle and available for assignment. If the car is idle, step 96 proceeds to step 98 which calls a subroutine ETA-A for computing the ETA time for the car to serve the hall call. FIG. 11 is a flowchart of a program 100 which implements the ETA-A subroutine, and it will be hereinafter described in detail.

Step 98 returns to program step 86 after running subroutine ETA-A, to determine if all of the cars have been considered relative to the call to be assigned or reassigned.

If step 96 finds that the car being considered is not an idle car available for assignment, step 102 checks to see if the car has a car call 3Z or an assigned up or down hall call 1Z or 2Z, respectively. If the car has no car call and no hall call assignment, it may be considered to be the same as an available car and the program calls subroutine ETA-A in step 98.

If step 102 finds that the car is busy, i.e., it has at least one car call or at least one assigned hall call, step 104 determines the floor of the farthest committed stop (FC floor) in the travel path of the car in serving its present workload. For example, if the car is traveling upwardly and its highest car call is for floor N−2, and it has no assigned hall calls which require further travel of the car, the FC floor would be N−2. If in addition to the car call at N−2, the car has been assigned a down hall call at floor N−4, then the FC floor would be N−4.

Figure 12:
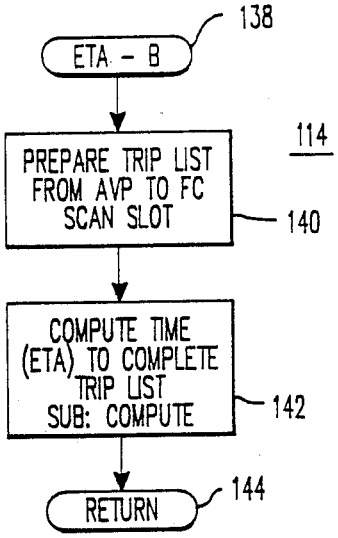
FIG. 12 is a flow chart of a subroutine ETA-B which establishes a second travel path for an elevator car to service a hall call to be assigned.

After the FC floor is determined, step 106 checks to see if the FC floor is related to a car call or an assigned hall call. If the FC floor is related to a car call, step 108 determines if the car travel direction is the same as the scanning direction through the hall call table 52 shown in FIG. 4. If the car is set for up travel and the scanning direction is upwardly through the up hall call table, or if the car is set for down travel and the scanning direction is downwardly through the down hall call table, step 108 proceeds to step 110. Step 110 determines if the scan slot floor (the floor of the hall call being considered) is closer to the AVP floor of the car than the previously determined FC floor. If the car will arrive at the scan slot floor before the FC floor, step 110 proceeds to step 98 to call subroutine ETA-A. If the car will arrive at the FC floor before reaching the scan slot floor, then step 110 proceeds to step 112. Step 112 calls a subroutine ETA-B to compute the ETA time for the car to arrive at the hall call floor. FIG. 12 is a flowchart of a program 114 which implements the ETA-B subroutine, and it will be hereinafter described in detail. Step 112 returns to step 86 to check for another car after subroutine ETA-B runs.

If step 108 found that the car travel direction was opposite to the scanning direction through the hall call table 52, then step 108 proceeds to step 112 to call subroutine ETA-B.

If step 106 found that the FC floor was not associated with a car call, then the FC floor is associated with a hall call assignment and the program branches to step 116. Step 116 is similar to step 108, determining if the car travel direction is the same or opposite to the scanning direction through hall call table 52. If the travel direction is the same as the scan direction step 118 checks to see if the car travel direction UPTR is the same as the service direction of the hall call at the FC floor. If the car travel direction is the same as the service direction of the hall call it had been previously assigned to serve, which call is located at the FC floor, step 118 returns to step 110 previously described. If the car travel direction is opposite to the direction of the hall call at the FC floor, then step 118 proceeds to step 98 to call subroutine ETA-A.

Figure 13:
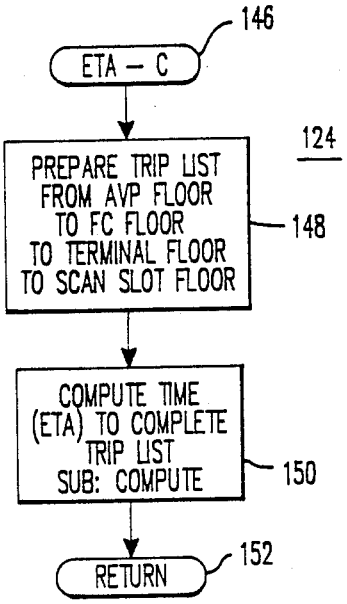
FIG. 13 is a flow chart of a subroutine ETA-C which establishes a third travel path for an elevator car to service a hall call to be assigned.

If step 116 finds the car travel direction UPTR is opposite to the scanning direction through the hall call table 52, step 116 proceeds to step 120. Step 120 determines if the car travel direction UPTR is the same as the direction of the hall call at the FC floor. If the directions are the same, step 120 proceeds to step 122 to call a subroutine ETA-C for computing the ETA time for the car to arrive at the scan floor. FIG. 13 is a flowchart of a program 124 which implements the ETA-C subroutine, and it will be hereinafter described in detail. Step 122 returns to step 86 after running subroutine ETA-C.

If step 120 finds that the car travel direction UPTR is opposite to the direction of the hall call at the FC floor, step 120 proceeds to step 126 to determine if the scan floor of the hall call being considered is farther from the AVP floor of the car than the previously determined FC floor. If the scan slot floor is farther from the AVP floor than the FC floor, step 126 proceeds to step 98 to call subroutine ETA-A. If the scan slot floor is not farther from the AVP floor than the FC floor, step 126 proceeds to step 112 to call subroutine ETA-B.

Subroutines ETA-A, ETA-B and ETA-C establish three different potential travel travel paths for determining ETA time. Subroutine ETA-A is entered at 128 and step 130 prepares a trip list for the car being considered from the advanced floor position AVP of the car to the scan slot floor. FIG. 7 illustrates the trip list 58, and it would be made out for the car in question, listing all stops between the AVP floor and the scan slot floor. If the car's AVP is the second floor and the scan slot floor is N−1, for example, all of the stops which the car is presently committed to make between these two floors would be listed. Step 132 computes the time for the car to complete its trip list and arrive at the scan slot floor. Step 132 calls a subroutine COMPUTE shown in FIG. 14, with FIG. 14 being a flowchart of a program 134 for computing ETA which will be hereinafter described. Subroutine ETA-A returns to the main program at 136 after computing and storing the ETA for the car in question for comparison with the ETA's of the remaining cars.

Subroutine ETA-B is entered at 138 and step 140 prepares a trip list for the car being considered from the AVP floor of the car to the FC floor, and from the FC floor to the scan floor. Thus, unlike ETA-A, which prepared a trip list from the car directly to the scan floor, ETA-B prepares a trip list from the car to the floor of the farthest committed call, i.e., the FC floor, and then from the FC floor to the floor of the hall call being considered for assignment, i.e., the scan floor. Step 142 calls the subroutine COMPUTE shown in FIG. 14 to compute the time for the car to complete its trip list, and the subroutine returns to the main program at 144.

Subroutine ETA-C is a subroutine used only when the FC floor is related to a hall call. Subroutine ETA-C is entered at 146 and step 148 prepares a trip list for the car being considered from the AVP floor of the car to the FC floor, from the FC floor to the terminal floor which is in the direction of the service direction of the hall call at the FC floor, and from this terminal floor to the hall call scan floor. Thus, unlike ETA-A, which prepares a trip list from the car directly to the scan floor, and unlike ETA-B which prepares a trip list from the car to the floor of the farthest committed call, i.e., the FC floor, and then from the FC floor to the floor of the hall call being considered for assignment, i.e., the scan floor, ETA-C prepares a trip list from the car to the FC floor, from the FC floor to a terminal floor, and then from the terminal floor to the scan floor. Step 150 calls the subroutine COMPUTE shown in FIG. 14 to compute the time for the car to complete its trip list, and the subroutine returns to the main program at 152.

The program 134 for the subroutine COMPUTE shown in FIG. 14 is entered at 154 and the purpose of the subroutine is to compute the ETA for the specific trip list prepared for the car. Step 156 checks to see if the car is moving. If either signal AGCCor signal DEC is true, the car is moving. If the car is not moving, step 158 checks signal DCL to see if the car doors are closed. If the car doors are closed, step 160 checks start command signal ACCX to determine if the car has just arrived or is preparing to leave the floor. If the car is not leaving it has just arrived, or is parked at the floor with its doors closed. Step 162 determines if the floor at which the car is located is the scan floor, i.e., the floor of the hall call to be assigned. In this instance it is not the scan floor, as the hall call would have been cancelled when the car started decelerating to stop at the floor, and step 162 proceeds to step 164 to see if the car is a busy car or an available car by checking signal AVAS. If the car is not available, then it just stopped at the floor and step 166 adds the door cycle time DCYT to any previous ETA time computed for this car. If the car is available, then no door time is required as the car can start on its trip list without opening its doors. Step 166 and the "yes" branch from step 164 proceed to step 168 which checks to see if the next stop on the trip list is one floor from the present car position, i.e., a one-floor run. If the next stop is a one-floor run, step 170 adds the one-floor run time OFTT to any prior computed value of ETA, and stores the new ETA at a temporary location in RAM. Step 162 checks to see if this next stop, i.e., the one floor run, will bring the car to the scan floor. If not, step 166 adds the door cycle time DCYT to the car's ETA and returns to step 168. If the next stop on the trip list is not a one-floor run, step 172 adds the acceleration time ACCT to the car's ETA and proceeds to step 174. Step 174 determines how many floors will be passed at rated speed before reaching the next stop on the trip list, and multiplies this number by the time HST required for the car to travel between two floors at rated speed. This time, plus the deceleration time DECT to stop at the next stop are added to the car's ETA. Step 174 proceeds to step 162 to determine if the car has completed its trip list. When step 162 finds that the stop being considered is the scan slot floor, step 176 adds the time DOT to open the door at the scan slot floor to the car's ETA.

If step 158 finds the doors open, step 159 adds the door non-interference time NIT and the door-close time DCT to the car's ETA value. Step 159 proceeds to step 168.

Before the subroutine exits at 184 and returns to the main program, the present invention makes a dynamic modification to the ETA value of a car which has committed stops on its trip list behind the scan floor. Step 182 proceeds to step 183 which checks the trip list of the car under consideration for assignment to determine if the car has a committed stop between the AVP floor and the scan floor. If there is no such stop, step 183 proceeds to the program exit 184. If step 183 finds such a stop, step 185 retrieves the constant K from ROM 42 (see ROM map 60 in FIG. 8), it determines the absolute value of the number of floors between the AVP floor and the scan floor, using the trip list prepared for the car, and it divides the constant by the number of floors to obtain a bias value B. Step 185 then proceeds to step 187 which subtracts the bias value B from the car's ETA value, and the program exits at 184. The selection of the constant K determines how far from the car the bias is effective. Since there has to be an intervening stop between the AVP floor and the scan floor before step 185 is effective, step 185 will only be performed when the absolute value of "scan floor−AVP floor" is two or more. Thus, a K of twenty, for example, will provide a bias of 10 seconds when the intervening stop is adjacent to the scan floor and progressively less as the distance in floors increases.

In FIG. 14 step 185 uses the travel distance between the AVP floor and the scan floor, instead of the travel distance from the floor of the intervening stop to the scan floor. This is because if the stop is due to a hall call assignment, the assignment may be changed. It is thus better to use the greater travel distance in the calculation of step 185 and not unnecessarily bias the car's ETA.

Figure 14A:
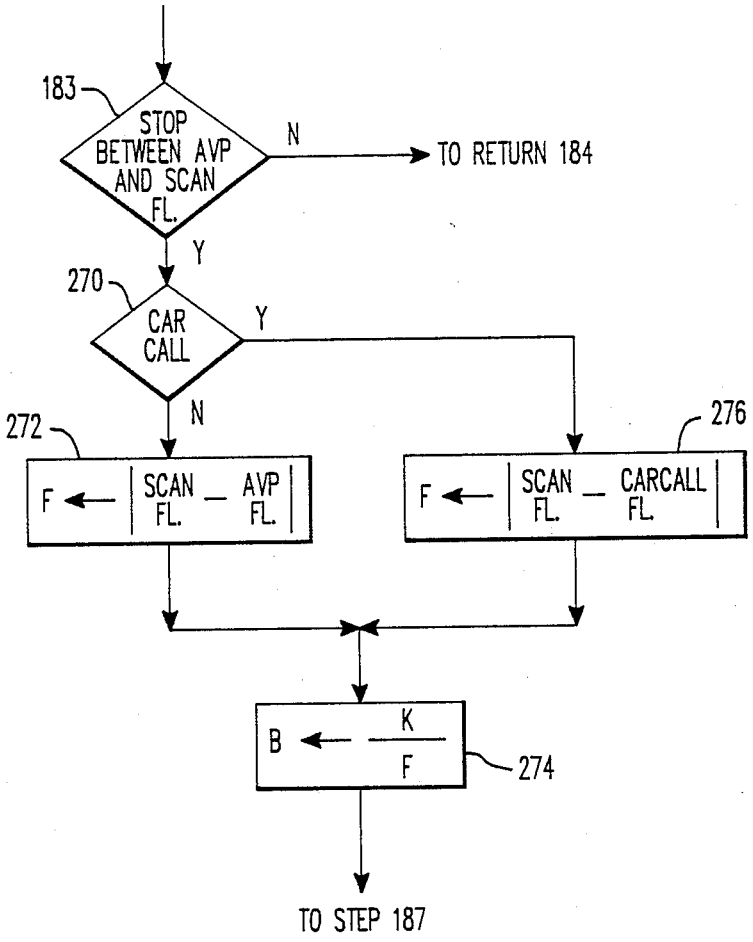
FIG. 14A illustrates a modification of the subroutine COMPUTE shown in FIG. 14.

FIG. 14A is a modification of program 134, according to the invention, which may be used between steps 183 and 187. This embodiment of the invention determines if the intervening stop, or the closest intervening stop to the scan floor when there is more than one, is due to an assigned hall call, or a car call. If it is due to an assigned hall call, a step similar to step 185 is used, i.e., the travel distance between the AVP floor and the scan floor. If the stop is due to a car call, it is known that the car will definitely stop at the floor of the hall call, and thus the travel distance used is that between the scan floor and the hall call floor, providing a greater bias for an intervening car call stop than for a prospective hall call stop.

More specifically, step 183 proceeds to step 270 which determines the nature of the closest intervening stop to the scan floor. If the stop is for an assigned hall call, step 272 determines the travel distance in floors between the scan floor and the AVP floor, and stores the result at a location for variables termed "F". Step 274 divides the constant K by F to determine the bias value B, and the program proceeds to step 187, hereinbefore described. If the stop is for a car call, step 270 proceeds to step 276 which determines the travel distance in floors between the car call floor and the scan floor, and stores the result at location F. Step 276 proceeds to step 274, which was just described.

If step 156 finds that the car is moving at the time its trip list is initiated, the car is accelerating, or it is at full speed, or it is already decelerating. Step 186 determines if the car is accelerating, and if it is, step 172 adds the accelerating time ACCT to the car's ETA, and advances to step 174, which was previously described. If the car is not accelerating, step 188 determines if the car is traveling at full speed. If it is traveling at full speed, step 188 advances to step 174. If the car is not accelerating and is not traveling at full speed, it is already decelerating and step 188 advances to step 190 which adds the "already decelerating" time ADT to the car's ETA. Step 190 advances to step 162. Thus, when all of the floor stops on the trip list have been considered, the car's ETA has been completed, and the subroutine returns to the main program 62 shown in FIG. 62.

When program 62 finds that the ETA times for all of the cars have been computed for the hall call in question, step 88 branches to step 90 which calls subroutine ASSIGN. Subroutine ASSIGN is a program 92 shown in FIG. 10 which is entered at 192. Step 194 compares the ETA values for all of the cars and determines which car # has the lowest ETA value. Step 196 determines if this hall call is a new call, or one which had been previously assigned to a car, by checking the assignment bit in assignment register 56 shown in FIG. 6. If the call is a new hall call, step 198 assigns the call to the car having the lowest ETA and the subroutine exits at 200 to return to the main program to consider the next hall call in the hall call table 52.

If the call had been previously assigned, step 196 advances to step 202 which determines the car # to which the call was assigned. Step 204 checks to see if the car #with the lowest ETA is the same car # to which the call had been previously assigned. If it is the same car, step 198 returns to the main program at 200.

If step 204 finds that the car having the lowest ETA is not the same as the car with the prior assignment, step 206 determines the difference between the ETA's of the two cars and step 208 determines if the new car's ETA time is lower than the ETA time of the prior assigned car by a predetermined number T. If the new car's ETA is not lower by T seconds, the assignment to the prior car is retained and step 208 returns to the main program. If the new car's ETA is lower than the prior car's ETA by more than T seconds, step 210 assigns the call to the new car and removes the assignment from the assignment register of the prior car. Step 210 returns to the main program 200.

Figure 15:
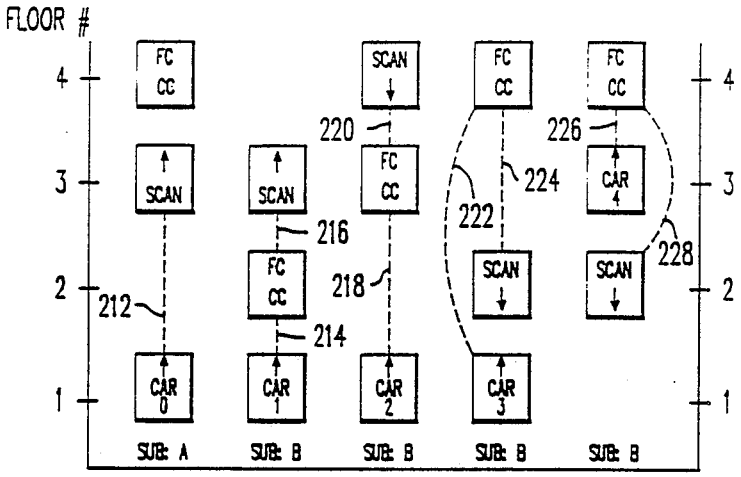
FIG. 15 is a chart which illustrates the operation of the programs in selecting travel paths for car in which its farthest committed stop is for a car call.

The chart of FIG. 15 lists examples of the travel paths for different relative positions of the AVP floor, the scan slot floor and the FC floor when the FC floor is related to a car call. The car call floor has no service direction, which simplifies the travel paths to those of subroutines ETA-A and ETA-B.

If the scan slot floor is between the AVP floor and the FC floor, the travel path and thus the trip list will be between the AVP floor and the scan slot floor, as indicated by dotted line 212. This is implemented by subroutine ETA-A. In the remaining examples, the travel path and trip list extends from the AVP floor to the FC floor, and from the FC floor to the scan floor, which is implemented by subroutine ETA-B.

More specifically, when the FC floor is between the AVP floor and the scan slot floor, the travel path if from the car to the FC floor and from the FC floor to the scan floor regardless of the car travel direction or scan direction. This is indicated by travel paths 214 and 216 for like travel and scan directions, and by travel paths 218 and 220 for unlike travel and scan directions.

When the scan floor is between the AVP floor and the FC floor, and the scanning direction is opposite to the car travel direction, the travel path extends from the AVP floor to the FC floor, indicated by travel path 222, which by-passes the scan floor, and then the travel path reverses, indicated by travel path 224, to extend from the FC floor to the scan floor.

When the FC floor is on one side of the AVP floor and the scan floor on the other side, with unlike travel and scan directions, travel path 226 is followed from the AVP floor to the FC floor, and the travel path then reverses, following path 228 from the FC floor to the scan floor.

Figure 16:
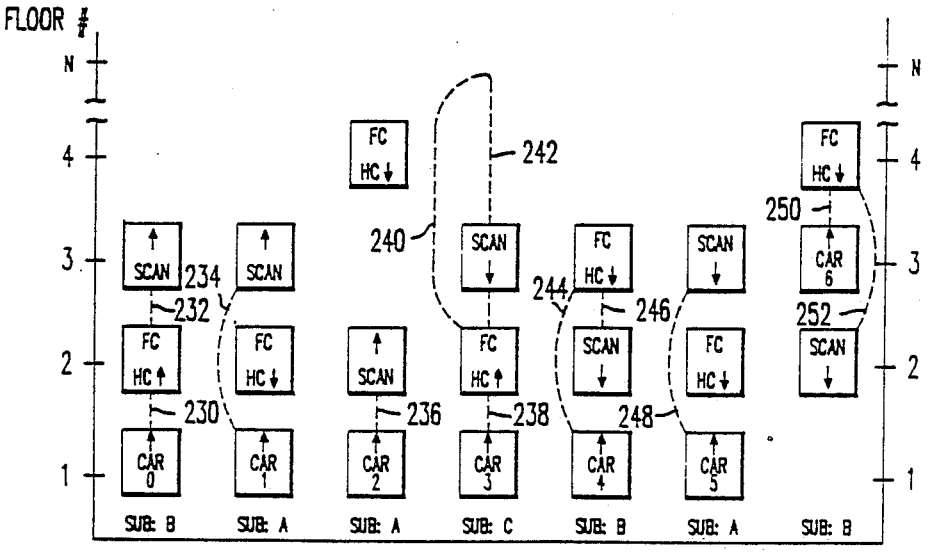
FIG. 16 is a chart which illustrates the operation of the programs in selecting travel paths for a car in which its farthest committed stop is for a hall call.

The chart of FIG. 16 lists examples of the travel paths for different relative positions of the AVP floor, the scan slot floor and the FC floor when the FC floor is related to a hall call. The hall call floor has a service direction, which requires the travel path provided by subroutine ETA-C in addition to the travel paths provided by subroutines ETA-A and ETA-B.

More specifically, if the FC floor is between the AVP floor and the scan floor, and the hall call at the FC floor has the same service direction as the car travel direction, subroutine ETA-B is selected which provides a travel path 230 from the AVP floor to the FC floor, and a travel path 232 from the FC floor to the scan floor.

When the FC floor is between the AVP floor and the scan floor, and the hall call at the FC floor has a service direction which is opposite to the car travel direction, subroutine ETA-A is selected, establishing a travel path 234 from the AVP floor to the scan floor. The assigned hall call at the FC floor is ignored during this determination, and if it should result that the car is assigned the hall call at the scan floor, the down hall call previously assigned to this car will probably be reassigned to another car.

In like manner, if the scan floor is closer to the AVP floor than the FC floor, the car travel direction is the same as the scan direction and opposite to the service direction of the hall call at the FC floor, travel path 236 will be followed from the AVP floor to the scan floor, with the assigned down hall call at the FC floor being ignored. This result will be provided by calling subroutine ETA-A.

When the FC floor is closer to the AVP floor than the scan floor, the car travel direction is the same as the service direction of the assigned hall call at the FC floor, and the scan direction is opposite to the car travel direction, the travel path includes a leg 238 from the AVP floor to the FC floor to service the up hall call. Since is is not known at this point how far the up hall call passenger will wish to travel in the up direction, it is assumed that the prospective passenger will place a car call for the longest trip, i.e., to the upper terminal floor N, providing a travel path 240 from the FC floor to the terminal floor N, and a travel path 242 from the terminal floor N to the scan floor. This result is provided by calling subroutine ETA-C.

When the scan floor is closer to the car than the FC floor and the car travel direction is opposite to both the scan direction and the service direction of the hall call at the FC floor, a travel path having a leg 244 extends from the AVP floor to the FC floor, and leg 246 extends from the FC floor to the scan floor. This requires subroutine ETA-B.

When the scan floor is closer to the AVP floor than the FC floor, and the car travel direction is opposite to both the scan direction and the service direction of the hall call at the FC floor, subroutine ETA-A is called which establishes travel path 248 from the AVP floor to the scan floor.

When the car's AVP floor is between the scan floor and the FC floor, and the car travel direction is opposite to both the scan direction and the service direction of the hall call at the FC floor, the travel path includes a leg 250 from the AVP floor to the FC floor, and a leg 252 from the FC floor to the scan floor.

We claim:

1. A method for assigning hall calls registered from floors of a building to a plurality of elevator cars which provide elevator service for the floors of the building, comprising the steps of:

selecting a travel path for each car relative to a floor having a registered hall call to be assigned, preparing a trip list for each car using the travel path selected, including stops to be made for car calls, and previously assigned hall calls, determining the time (ETA) for each car to service the associated trip list and arrive at the floor of a hall call under consideration, and assigning each hall call to an elevator car based upon the relative ETA times, said step of determining the ETA time for each car including the steps of:

determining if the car presently being considered has an intervening stop on its trip list, behind the floor of the hall call presently being considered, calculating a dynamic bias value when the car has such an intervening stop, with the dynamic bias value being inversely proportional to a car travel distance between two predetermined locations, and biasing the ETA time of the associated car by subtracting the bias value from the car's ETA time.

2. The method of claim 1 wherein the two predetermined locations are a floor position related to the elevator car and the floor of the hall call being processed.

3. The method of claim 2 wherein the step of calculating a bias value divides a predetermined constant value by the number of floors which separate the car position from the floor of the hall call being considered, with the car position being the floor at which a stationary car is located, and the floor at which a moving car can make a normal stop.

4. The method of claim 1 including the step of determining if an intervening stop on a trip list behind the floor of the hall call presently being considered is due to an assigned hall call or a car call, with the two predetermined locations being a floor position related to the elevator car and the floor of the hall call being processed when the intervening stop is a hall call stop, and the two predetermined locations are the floor of the car call and the floor of the hall call being processed, when the intervening stop is a car call stop.

5. The method of claim 4 wherein the step of calculating a bias value divides a predetermined constant value by the number of floors which separate the car position from the floor of the hall call being considered, with the car position being the floor at which a stationary car is located, and the floor at which a moving car can make a normal stop.

* * * * *